US007131543B2

(12) United States Patent
Mason

(10) Patent No.: US 7,131,543 B2
(45) Date of Patent: Nov. 7, 2006

(54) DISPLAY DEVICE

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 128 days.

(21) Appl. No.: 10/728,483

(22) Filed: Dec. 5, 2003

(65) Prior Publication Data

US 2004/0195195 A1 Oct. 7, 2004

Related U.S. Application Data

(63) Continuation-in-part of application No. 29/174,678, filed on Jan. 22, 2003, now abandoned, and a continuation-in-part of application No. 29/176,492, filed on Feb. 24, 2003, now Pat. No. Des. 489,556, and a continuation-in-part of application No. 29/177,331, filed on Mar. 7, 2003, now Pat. No. Des. 486,324.

(51) Int. Cl.
*A47F 1/04* (2006.01)
*A47B 97/00* (2006.01)

(52) U.S. Cl. ..... 211/59.2; 211/135; 280/79.3; 312/249.8; 312/349; 312/351.11

(58) Field of Classification Search ..... 220/761; 211/59.2, 151, 189, 135; 280/79.3; 312/249.8, 312/349, 351.11; 222/902; 206/123; 221/82; 248/240.1
See application file for complete search history.

(56) References Cited

U.S. PATENT DOCUMENTS 1,317,534 A 9/1919 Williams
1,662,637 A * 3/1928 Chase ..... 211/59.2
1,711,329 A 4/1929 Short
1,931,403 A * 10/1933 Connor ..... 312/42
2,439,660 A * 4/1948 Keil ..... 280/37
2,649,207 A 8/1953 Shield
2,943,742 A * 7/1960 Colley ..... 211/59.2
3,006,707 A * 10/1961 Rossi ..... 312/121
3,019,907 A 2/1962 Belejack
3,286,846 A 11/1966 Brandes
3,377,771 A * 4/1968 Schmidt, Sr. ..... 53/153
3,404,927 A 10/1968 Mellion
D223,041 S 2/1972 Kuenster
3,687,091 A * 8/1972 Boylan ..... 108/60
3,900,112 A 8/1975 Azzi et al.
3,923,159 A 12/1975 Taylor et al.
3,977,523 A 8/1976 Cousino
4,077,522 A 3/1978 Trubiano
4,287,992 A 9/1981 Takemori
D268,068 S 3/1983 Ellenson et al.
4,562,927 A * 1/1986 Fredrickson ..... 211/59.2
4,598,828 A * 7/1986 Young et al. ..... 211/59.2
4,662,523 A 5/1987 Stein et al.
4,684,027 A 8/1987 Wright (Continued)

*Primary Examiner*—Richard E. Chilcot, Jr.
*Assistant Examiner*—Jared W. Newton
(74) *Attorney, Agent, or Firm*—Collard & Roe, P.C.

(57) ABSTRACT

A display device for at least one modular merchandise unit having a substantially flat base includes a base, a housing supported by the base, a cover, at least one wheel connected to the base, and at least one shelf supported in the housing for receiving the base of the merchandise unit. The housing includes parallel first and second side walls and a third side wall connected to the first and second side walls. The cover is disposed on an upper portion of the first, second and third side walls.

3 Claims, 5 Drawing Sheets

U.S. PATENT DOCUMENTS 4,744,489 A 5/1988 Binder et al.
5,353,939 A 10/1994 Beeler et al.
D381,546 S 7/1997 Hunt
5,706,953 A * 1/1998 Polvere ..... 206/736
5,788,090 A 8/1998 Kajiwara
D404,240 S 1/1999 Man
5,899,345 A * 5/1999 Fuller et al. ..... 211/132.1
6,044,989 A 4/2000 Sosso
D428,738 S 8/2000 Brozak, Jr.
6,105,796 A * 8/2000 Buchanan et al. ..... 211/128.1
6,290,077 B1 9/2001 Sosso
6,405,880 B1 6/2002 Webb
6,427,857 B1 * 8/2002 Adams et al. ..... 211/189
6,561,365 B1 * 5/2003 Bustos ..... 211/187
6,637,604 B1 10/2003 Jay
D486,324 S * 2/2004 Mason ..... D6/473
D489,556 S * 5/2004 Mason ..... D6/511
6,783,012 B1 * 8/2004 Webb ..... 211/59.2
D496,193 S * 9/2004 Mason ..... D6/468
D496,194 S * 9/2004 Mason ..... D6/468
6,877,618 B1 * 4/2005 Mason ..... 211/59.2
6,955,268 B1 * 10/2005 Waldron ..... 211/51
D511,426 S * 11/2005 Mason ..... D6/459
D512,260 S * 12/2005 Melnyk ..... D6/630
2004/0007546 A1 1/2004 Stinnett et al.

* cited by examiner

DISPLAY DEVICE

CROSS REFERENCE TO RELATED APPLICATIONS

This application is a Continuation-in-Part (CIP) application of U.S. patent application Ser. No. 29/174,678 filed on Jan. 22, 2003, entitled "Design for a SHELF"; U.S. patent application Ser. No. 29/176,492 filed on Feb. 24, 2003, entitled "Design for a SHELF"; and U.S. patent application Ser. No. 29/177,331 filed on Mar. 7, 2003, entitled "Design for a DISPLAY UNIT". Priority is claimed under 35 U.S.C. §120 based on those applications.

BACKGROUND OF THE INVENTION

1. Field of the Invention

The present invention relates to display devices and more particularly to a display device having shelves designed to hold modular merchandise units such as packet boxes that may be transported to a point of sale location filled with merchandise and readily arranged with similar display units in different configurations.

2. The Prior Art

Batteries and other articles of merchandise are often packaged in modular merchandise units such as packet boxes, called "MODS" or "PDQs" which have a substantially flat base. At the present time, these modular merchandise units are loaded on disposable display devices made of corrugated cardboard. These cardboard display devices usually have capacity for receiving only one horizontal row of modular merchandise units. If the device were constructed to hold more than one unit deep of merchandise, it would be impractical to ship the device with merchandise to the retail establishment due to the weight of the product. Moreover, such know display devices lack durability and typically are discarded at the retail establishment once all the products in the display device have been dispensed. Most of the time, therefore, a partially-filled display device is presented to the customer as products removed from the display device are not replaced, leaving empty spaces in the display device. In addition, such display devices are difficult to move when filled with product. As a result, once placed at a particular location, the display device is not moved until emptied and discarded.

Hence, there is a need for a simple and economic display device which may be filled with more than one row of modular merchandise units, may be shipped fully loaded with such units to a retail establishment, may be reused by the retail establishment and replenished with products, and may be readily and easily moved while filled with products to different locations at the retail establishment.

SUMMARY OF THE INVENTION

A display device is provided for at least one modular merchandise unit having a substantially flat base. The device includes a base, a housing supported by the base, a cover, at least one wheel connected to the base, and at least one shelf supported in the housing for receiving the base of the merchandise unit.

The housing includes parallel first and second side walls and a third side wall connected to the first and second side walls. The cover is disposed on an upper portion of the first, second and third side walls.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
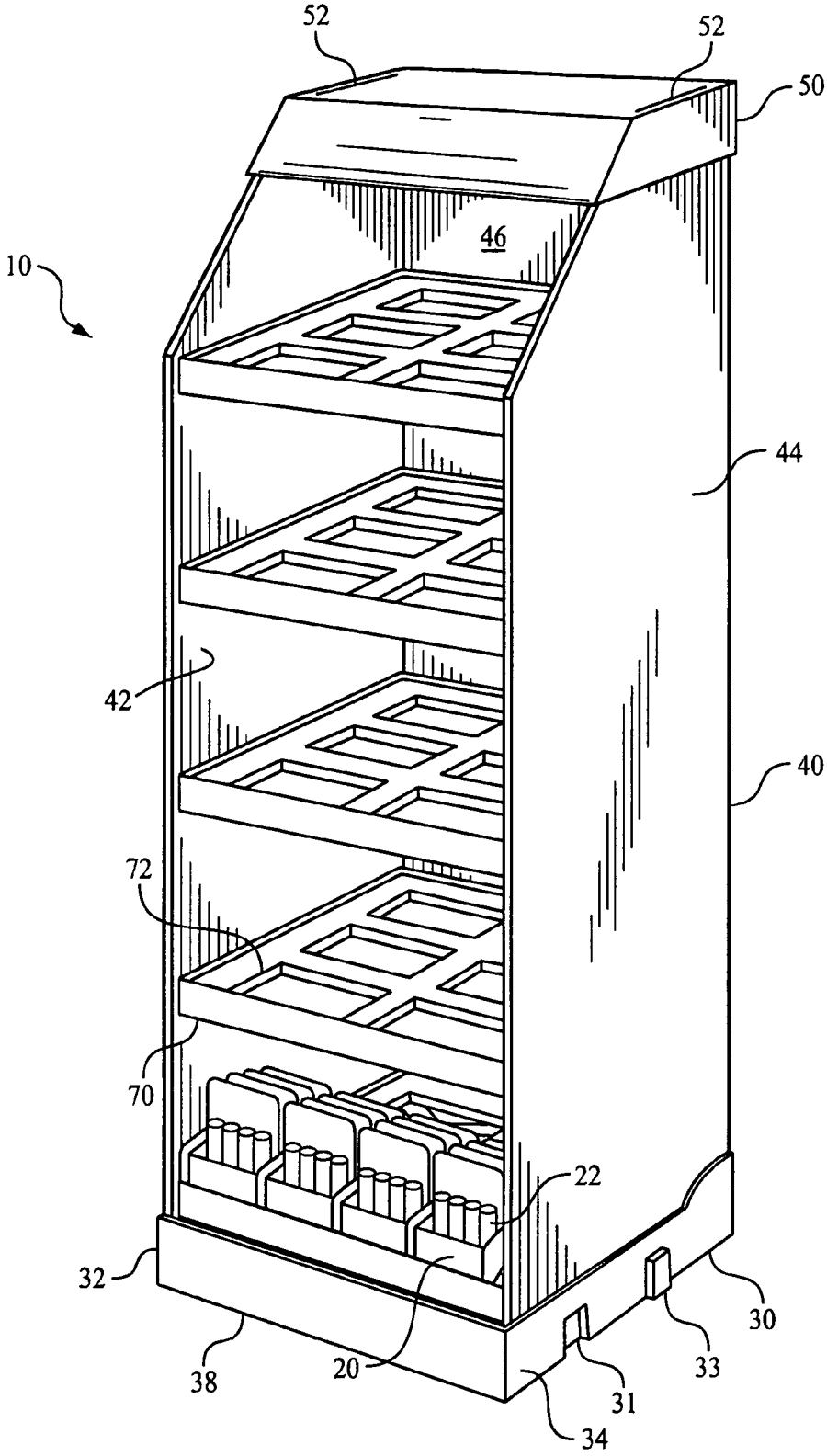
FIG. 1 is a perspective view of an embodiment of a display device in accordance with the invention.

Turning now to the drawings, FIG. 1 shows a display device 10 for at least one modular merchandise unit, such as battery package carrier 20. As shown in FIG. 1, each modular merchandise unit preferably is presented to the consumer in a substantially upright or perpendicular position. Modular merchandise unit 20 has a substantially flat base and holds a number of merchandise packages 22, for example, four as shown in FIG. 1.

Figure 2:
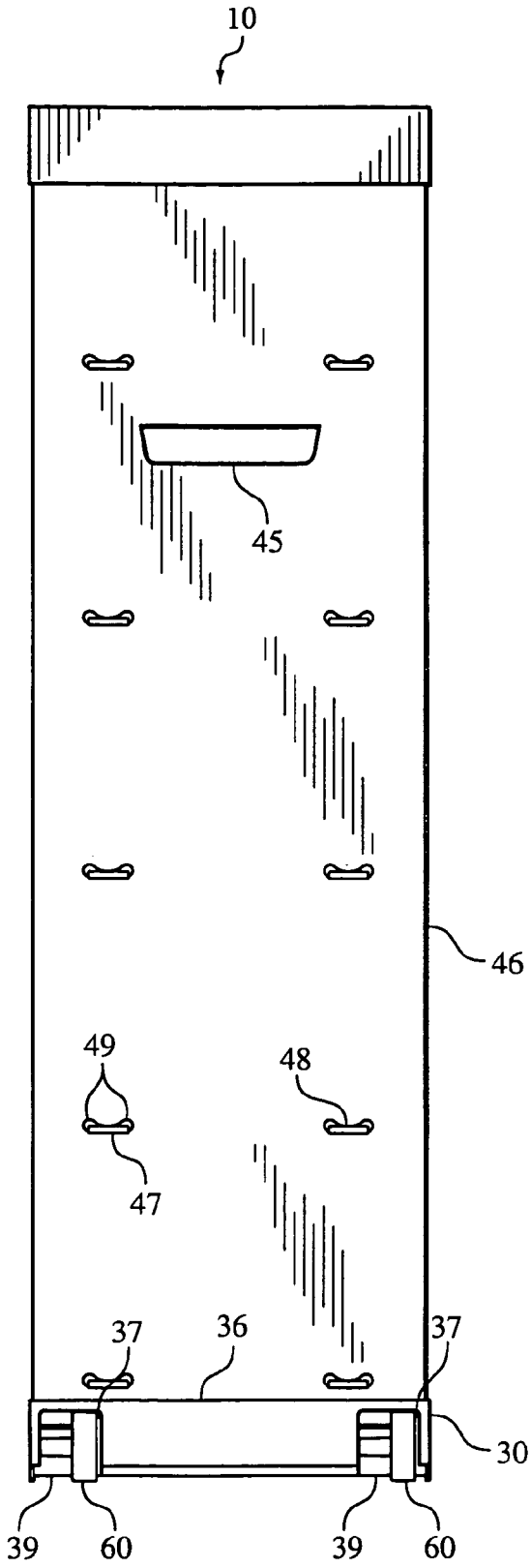
FIG. 2 is a rear view of the embodiment of FIG. 1.

Device 10 has a base 30, a housing 40 supported by the base 30, and a cover 50. As shown in FIG. 2, device 10 also includes at least one wheel 60 connected to base 30. At least one shelf 70, shown in FIG. 1 is supported in housing 40 for receiving the base of merchandise unit 20.

Housing 40 includes parallel first and second side walls 42, 44 and a third side or back wall 46 connected to first and second side walls 42, 44. As shown in FIG. 2, third side wall 46 preferably includes a plurality of shelf openings 48. Each shelf opening includes a substantially horizontal portion 47 for supporting an end portion of a shelf 70 and curved portions 49 disposed on each side of horizontal portion 47 to facilitate insertion and removal of the end portion into and from shelf opening 48. Shelf openings 48 are preferably arranged in at least two parallel rows of shelf openings in third side wall 46 with each shelf 70 being supported in at least two shelf openings 48.

As shown in FIG. 2, third side wall 46 preferably includes an opening 45 for use as a handle to pivot display device 10 on wheels 60. In this way, display device 10 may be easily and conveniently moved from place to place by rolling the pivoted display device on wheels 60 and returning display device 10 to an upright position once moved to the new location.

Base 30 preferably includes parallel first and second base walls 32, 34 aligned with first and second side walls 42, 44 as shown in FIG. 1. Base 30 also includes third and fourth base walls 36, 38 connected to first and second base walls 32, 34. As shown in FIG. 2, third base wall 36 is aligned with third side wall 46.

Each of first and second base walls 32, 34 have a guide opening 31 and a guide member 33 for alignment of display device 10 with additional display devices on either side of display device 10. Display device 10 may be constructed so that guide opening 31 on second base wall 34 is closer to fourth base wall 38, i.e. the front of display device 10 with guide member 33 closer to third base wall 36 or the back of display device 10. The relative positions of guide opening 31 and guide member 33 are reversed on first base wall 32 so that the guide opening on the first or left base wall 32 of display unit 10 will receive the guide member on the second or right base wall 34 of a first additional display device placed on the left side of display unit 10. At the same time the guide member on the first or left base wall 32 of display unit 10 will be received within the guide opening on the second or right base wall 34 of the first additional display device.

Similarly, the guide opening on the second or right base wall 34 of display unit 10 will receive the guide member on the first or left base wall 32 of a second additional display device placed on the right side of display unit 10, with the guide member on the second or right base wall 34 of display unit 10 received within the guide opening on the first or left base wall 32 of the second additional display device.

Alternatively, the relative positions of guide opening 31 and guide member 33 on first and second base walls 32, 34 may be the same. In this case, the first and second additional display devices will each face in the opposite direction to display device 10.

Third base wall 36 has a plurality of wheel wells 37 and a plurality of wheel guide openings 39, which may be formed as a part of wheel wells 37, adjacent to wheel wells 37 for alignment and locking in place of display device 10 with a third additional display device. As shown in FIG. 2, preferably each display device has two wheels 60 disposed respectively in two wheel wells 37 and has two wheel guide openings 39 to the left of wheels 60. When another or third additional display device is placed with its third or back side wall against third side wall 46 of display unit 10, wheels 60 of display device will be positioned to be received within the wheel guide openings of the third additional display device, and the wheels of the third additional display device will be positioned to be received within wheel guide openings 39 of display device 10.

Cover 50 preferably includes a plurality of slots 52 disposed therein for receipt of advertising material such as display cards advertising the product being displayed in display device 10.

Preferably, as shown in FIG. 1, at least five shelves 70 are provided in display device 10. Each shelf 70 is connected to first and second side walls 42, 44 and to third side wall 46. Preferably, each shelf 70 is of sufficient depth to retain at least three modular merchandise units 20. In other words, at least three horizontal rows of modular merchandise units may be held by each shelf 70.

In the embodiment shown in FIG. 1, each shelf 70 includes a substantially flat portion 72 which is adapted to hold at least two rows parallel to first and second side walls 42, 44 of at least three modular merchandise units. For example, in FIG. 1, the front of four parallel rows of modular merchandise units 20 is shown. However, each shelf 70 may be designed to accommodate a fewer or greater number of parallel rows of modular merchandise units 20. When shelf 70 is filled, each row is at least three modular merchandise units deep.

Figure 3:
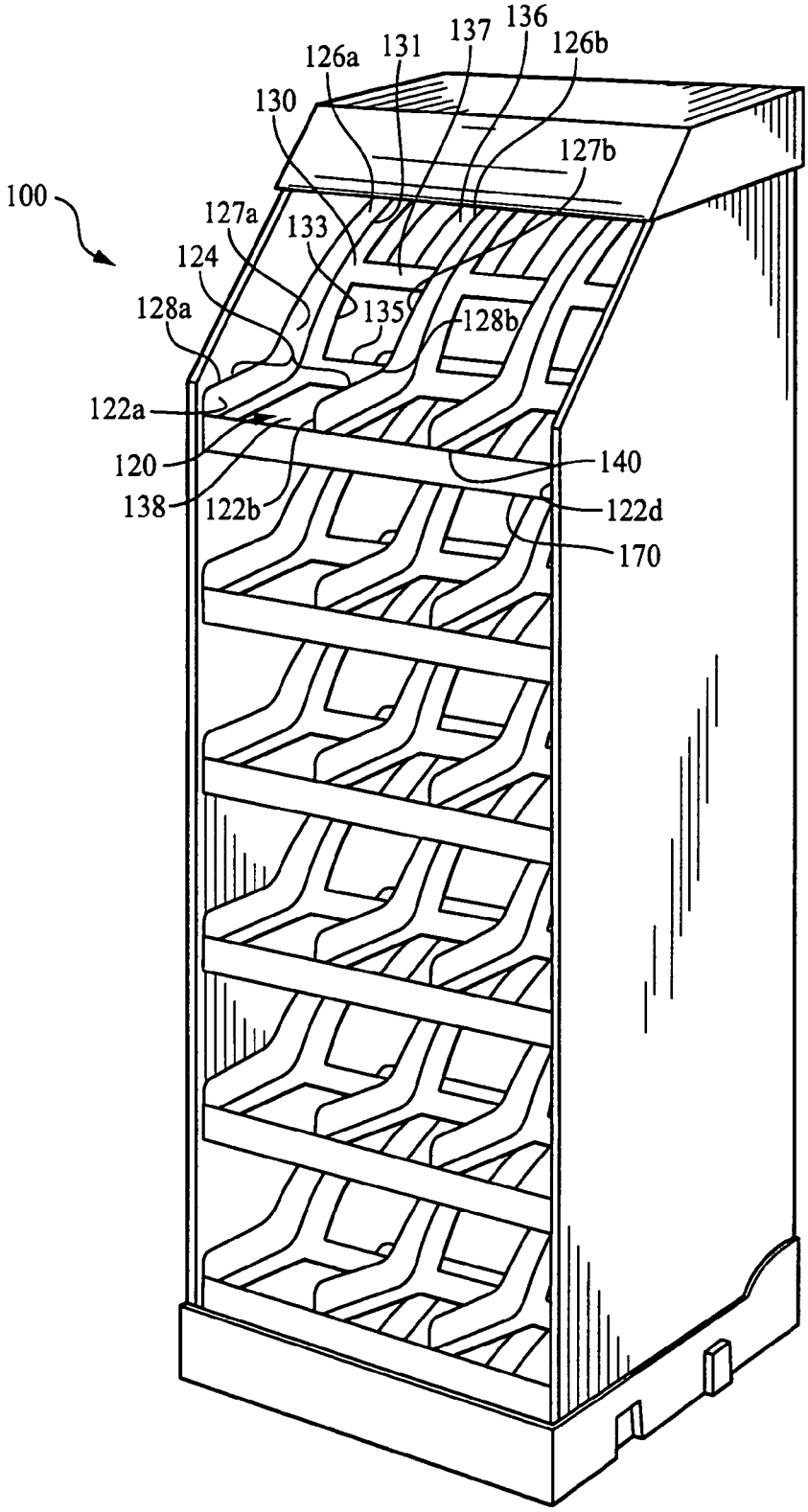
FIG. 3 is a perspective view of a further embodiment of a display device in accordance with the invention.

FIG. 3 shows a further embodiment of a display device according to the invention. Display device 100 is generally the same as display device 10 of the embodiment shown in FIG. 1 except that a shelf 170 according to Applicant's co-pending U.S. patent application Ser. No. 29/176,492 filed on Feb. 24, 2003 is used in place of flat shelf 70 shown in FIG. 1. Preferably, at least six shelves 170 are provided in display unit 100 as shown in FIG. 3 and are connected thereto in a manner similar to that described with respect to display unit 10. As with flat shelves 70 shown in FIG. 1, each shelf 170 preferably holds at least three modular merchandise units. For example, each shelf 170 shown in FIG. 3 holds three rows of modular merchandise units, with each row being at least three modular merchandise units deep.

As shown in FIG. 3, each shelf 170 has a track 120 formed by two spaced walls 122*a*, 122*b* defining a channel 124 between walls 122*a*, 122*b*. Preferably, shelf 170 has a-number of adjacently-spaced walls defining at least two channels.

A support 130 connects lower portions of each set of wall pairs, such as walls 122*a*, 122*b*. Support 130 may include transverse brackets or cross-members 135 as shown in FIG. 3 to provide support for the shelf. In the embodiment shown in FIG. 3, each shelf 170 has three track supports connecting lower portions of adjacent ones of the wall pair sets. Support 130 receives and supports the flat base of a modular merchandise unit placed thereon. Preferably, support 130 includes at least two spaced-apart members 131 connected to a portion of a respective wall on opposite sides of the channel for ends of the base of the modular merchandise unit to ride on. In this way, support 130 may have a large amount of open space 133 between the members which are near the walls as shown in FIG. 3.

The support and preferably also the walls have a rearward portion elevated at a first angle, a substantially horizontal forward portion, and an intermediate portion connecting the rearward and forward portions elevated at a second angle greater than the first angle. For example, as shown in FIG. 3, track 120 has an inclined rearward portion formed by rearward portions 126*a*, 126*b* of walls 122*a*, 122*b;* a substantially horizontal forward portion formed by forward portions 128*a*, 128*b* of walls 122*a*, 122*b;* and an intermediate portion connecting the rearward and forward portions formed by intermediate portions 127*a*, 127*b* of walls 122*a*, 122*b*. Preferably, a connector 140 connects the forward portions of wall 122*a* and the outer wall 122*d* of shelf 170 on the right side of display device 100 as shown in FIG. 3.

Support 130 has a rearward portion 136 elevated at a first angle, a substantially horizontal forward portion 138, and an intermediate portion 137 connecting rearward portion 136 and forward portion 138. Intermediate portion 137 is elevated at a second angle greater than the first angle, i.e. greater than the angle of the rearward portion relative to the horizontal. For example, the first angle may be approximately 21° and the second angle may be approximately 41°. Forward portion 138 is substantially horizontal, for example, elevated at 2° relative to horizontal. By increasing the incline in the intermediate position, the shelf is able to accommodate multiple modular units within each channel without the risk of the unit being stalled within the channel from lack of gravitational force. Thus, the modular units feed fully in the channel so that they descend, without getting stuck, to the dispensing portion of the display. The product thus will descend to the forward portion of support 130 and be presented in a position perpendicular to the consumer.

Preferably, the inclined rearward portions of track 120 and support 130 are inclined at an angle between 155° and 170° relative to the horizontal. In other words, the inclined rearward portions are elevated at an angle with respect to the horizontal between 10° and 25°. The forward portions of track 120 and support 130 may be inclined at an angle between 135° and 145°, i.e. elevated at an angle with respect to the horizontal between 35° and 45°.

Figure 4A:
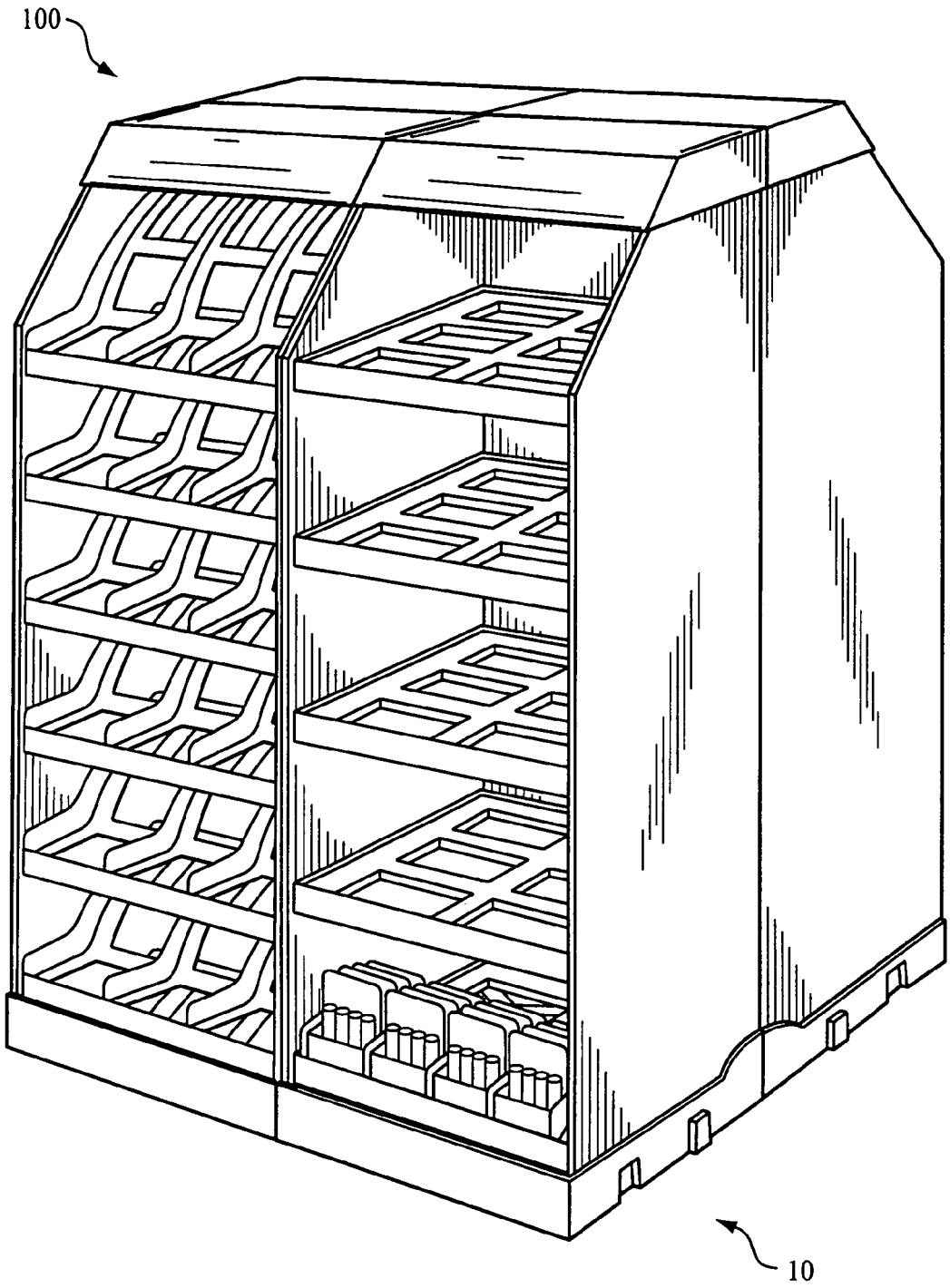
FIG. 4A is a perspective view of an arrangement using four display devices including the embodiments of FIGS. 1 and 3.

The display units may be placed in various configurations using two or more of the same or different embodiments of the display units. For example, four display devices may be arranged so that two display devices of the embodiment of FIG. 1 may be placed back to back and two or four display devices of the embodiment of FIG. 3 may be placed on either side of the embodiments of FIG. 1. For example, FIG. 4A shows four display devices including display device 100 and display device 10 facing front and two additional display devices facing the opposite way with their backs against the backs of the front devices.

Figure 4B:
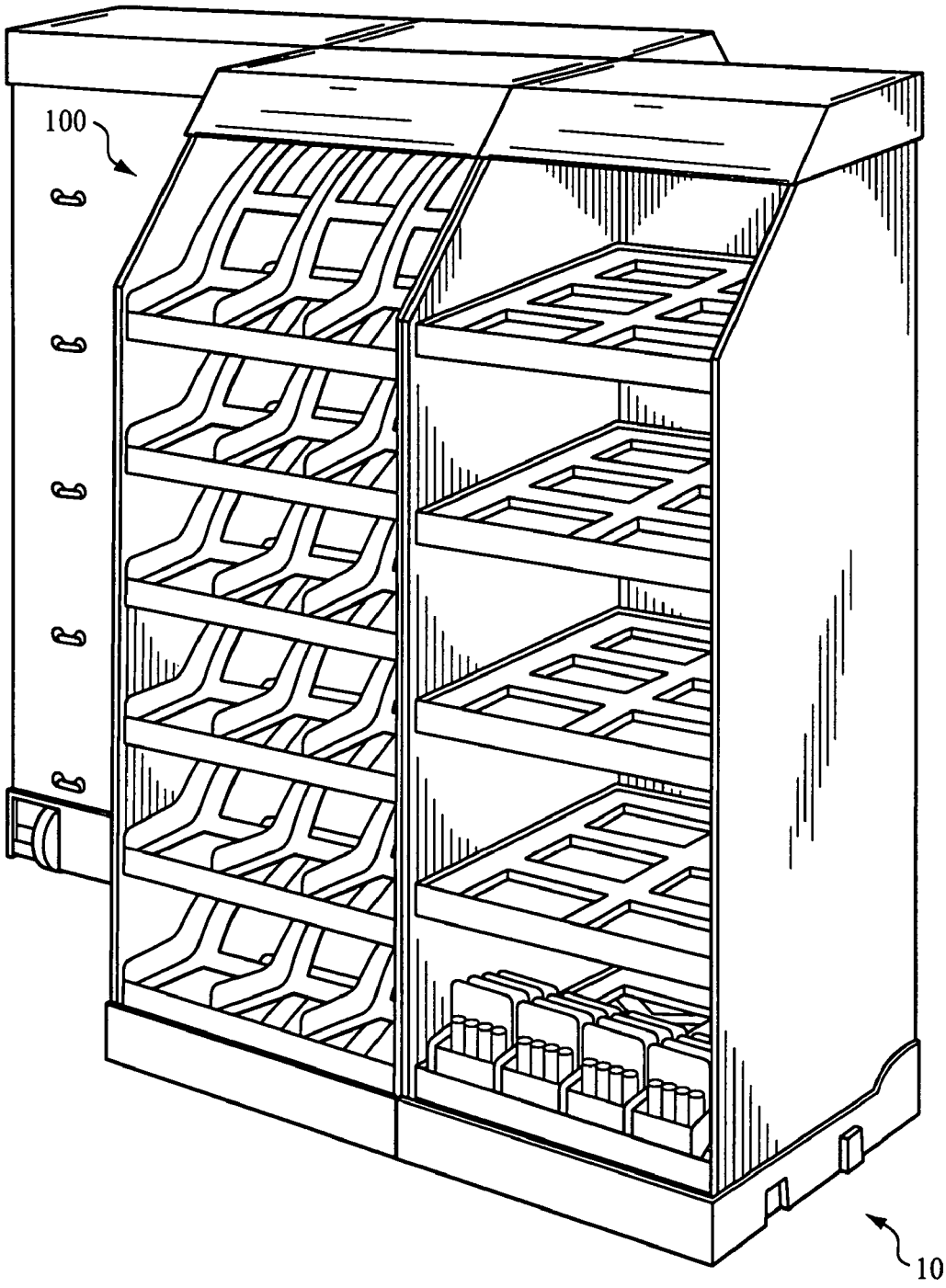
FIG. 4B is a perspective view of another arrangement using four display devices including the embodiments of FIGS. 1 and 3.

Another arrangement is shown in FIG. 4B using four display devices and has two display devices of either embodiment back to back, a third display device on one side of the front display device and a fourth display device on an opposite side of the back display device. This "pin wheel" arrangement is a useful way to position four display devices of the present invention.

The display devices of the present invention represent an improvement over existing corrugated cardboard display devices which are typically only one modular merchandise unit deep. The display devices of the present invention may be filled at least three modular merchandise units deep and be shipped fully loaded to the retail location. Therefore, there is at least a three-fold increase in the stock keeping unit (SKU) for the display device, which results in an increase in the time before the display device needs replenishing.

Unlike corrugated cardboard display devices which lack durability in use and are thrown out after the product is depleted, the display device of the present invention will hold up in use and can be reloaded with product and reused.

Preferably, display unit is 48" in height with six tiers of shelves holding three rows of modular merchandise units or five tiers of shelves holding four rows of modular merchandise units. The display devices may be assembled on a pallet with two display devices in front and two display devices in back and shipped fully loaded to the retail location. At the retail location, the devices may be left on the pallet or separated from one or more of each other by using the handle openings at the rear side of each display device to pivot the display device on the wheels and move it around the store to a selected location.

The display device is relatively inexpensive to construct and preferably is made from injection molded plastic with steel corners. Relatively few pieces are needed to construct the display device. For example, a display device may be assembled from as little as eleven separate pieces.

The lock-in base for the wheels and sides of the display device facilitates both shipment and stability of the arrangement of the display devices at the selected retail location. The display device may accommodate both flat-feed shelves and gravity-feed shelves.

While only a few embodiments of the present invention have been shown and described, it is to be understood that many changes and modifications may be made thereunto without departing from the spirit and scope of the invention as defined in the appended claims.

What is claimed is:

1. A display device for at least one modular merchandise unit having a substantially flat base comprising:

(a) a base comprising parallel first and second base walls and parallel third and fourth base walls connected to said first and second base walls;

(b) a housing supported by said base comprising parallel first and second side walls and a third side wall connected to said first and second side walls, said third side wall comprising a plurality of support openings arranged in at least two parallel rows of support openings in said third side wall;

(c) at least one shelf supported in said housing for receiving the base of a merchandise unit, with each shelf being supported in at least two support opening;

(d) a cover disposed on an upper portion of said first, second and third side walls;

(e) at least two-wheels connected to said base and disposed in wheel wells provided in said base;

wherein said first and second base walls are aligned with said first and second side walls, and said third base wall is aligned with said third side wall;

each of said first and second base walls has a guide opening and a guide member for alignment of said display device with first and second additional display devices; and said third base wall further comprises wheel guide openings adjacent to said wheel wells for alignment of said display device with a third additional display device.

2. The display device according to claim 1 wherein said third side wall further comprises an opening for use as a handle to pivot said device on said at least two wheels.

3. The display device according to claim 1 further comprising a plurality of slots disposed in said cover for receipt of advertising material.

* * * * *

UNITED STATES PATENT AND TRADEMARK OFFICE

CERTIFICATE OF CORRECTION

PATENT NO. : 7,131,543 B2
APPLICATION NO. : 10/728483
DATED : November 7, 2006
INVENTOR(S) : Mason It is certified that error appears in the above-identified patent and that said Letters Patent is hereby corrected as shown below:

In particular, in Column 6, line 25 (line 3 of subparagraph (c) in Claim 1), after the word "support" please change "opening" to correctly read: --openings--.

Signed and Sealed this

Ninth Day of January, 2007

JON W. DUDAS
*Director of the United States Patent and Trademark Office*